US011386820B2

(12) United States Patent
Li et al.

(10) Patent No.: US 11,386,820 B2
(45) Date of Patent: Jul. 12, 2022

(54) METHOD OF DETECTING THRESHOLD VOLTAGE SHIFT AND THRESHOLD VOTAGE SHIFT DETECTION DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Guangyao Li, Beijing (CN); Dongfang Wang, Beijing (CN); Jun Wang, Beijing (CN); Haitao Wang, Beijing (CN); Chaowei Hao, Beijing (CN); Bo Feng, Beijing (CN); Rong Liu, Beijing (CN); Wei Cai, Beijing (CN); Biao Luo, Beijing (CN); Xuechao Sun, Beijing (CN); Xuehai Gui, Beijing (CN); Qibin Liang, Beijing (CN); Yanfei Wan, Beijing (CN); Jin Su, Beijing (CN)

(73) Assignees: HEFEI XINSHENG OPTOELECTRONICS TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/040,913

(22) PCT Filed: Apr. 21, 2020

(86) PCT No.: PCT/CN2020/085854
§ 371 (c)(1),
(2) Date: Sep. 23, 2020

(87) PCT Pub. No.: WO2020/238486
PCT Pub. Date: Dec. 3, 2020

(65) Prior Publication Data

US 2021/0241664 A1 Aug. 5, 2021

(30) Foreign Application Priority Data

May 30, 2019 (CN) ..... 201910463495.4

(51) Int. Cl.
*G09G 3/3233* (2016.01)
*G09G 3/00* (2006.01)
*G09G 3/3225* (2016.01)

(52) U.S. Cl.
CPC ..... *G09G 3/006* (2013.01); *G09G 3/3225* (2013.01); *G09G 2300/0426* (2013.01); *G09G 2300/0809* (2013.01); *G09G 2330/02* (2013.01)

(58) Field of Classification Search
CPC ..... G09G 3/006; G09G 3/3225; G09G 2300/0426; G09G 2300/0809;
(Continued)

(56) References Cited

U.S. PATENT DOCUMENTS

2004/0171221 A1* 9/2004 Takatori ..... G02F 1/13306 438/281
2004/0263670 A1* 12/2004 Yamasaki ..... G09G 3/3208 348/340
(Continued)

FOREIGN PATENT DOCUMENTS

CN 105374320 A 3/2016
CN 107025884 A 8/2017
(Continued)

OTHER PUBLICATIONS

Office Action of CN Application No. 201910463495.4 and English translation, dated Feb. 9, 2021, 16 pages.
(Continued)

*Primary Examiner* — Jose R Soto Lopez
(74) *Attorney, Agent, or Firm* — Muncy, Geissler, Olds & Lowe, P.C.

(57) ABSTRACT

A method of detecting threshold voltage shift and a threshold voltage shift detection device are provided. The method
(Continued)

is applied to a pixel driving circuit which I is electrically coupled to a control line, a voltage line and a detection node, respectively. The method includes: in a detection cycle including a setting phase and a detection phase, in the setting phase, controlling a transistor included in the pixel driving circuit to be in a biased state; in the detection phase, providing a preset control voltage signal to the control line, providing a preset voltage signal to the voltage line, and determining a threshold voltage shift state of the transistor according to an electric potential of the detection node.

7 Claims, 2 Drawing Sheets

(58) Field of Classification Search
CPC ..... G09G 2330/02; G09G 2320/0295; G09G 2320/041; G09G 2320/0666; G09G 2330/12
See application file for complete search history.

(56) References Cited

U.S. PATENT DOCUMENTS

2008/0024157 A1* 1/2008 Jun ..... G09G 3/006 324/750.05
2008/0079684 A1* 4/2008 Novoselov ..... G09G 3/3677 345/100
2008/0238953 A1* 10/2008 Ogura ..... G09G 3/3275 345/697
2010/0039422 A1* 2/2010 Seto ..... G09G 3/3233 345/212
2011/0108837 A1* 5/2011 Yamazaki ..... H01L 29/045 257/E29.296
2011/0164025 A1* 7/2011 Saito ..... G09G 3/3233 345/212
2012/0056186 A1* 3/2012 Shirouzu ..... G02F 1/136204 257/E29.273
2013/0243304 A1* 9/2013 Jin ..... G09G 3/006 324/414
2014/0168194 A1* 6/2014 Kong ..... H01L 29/78645 345/212
2015/0084946 A1* 3/2015 Shim ..... G09G 3/3291 345/212
2015/0161968 A1* 6/2015 Hayashi ..... G09G 3/3291 345/82
2015/0187276 A1* 7/2015 Shim ..... G09G 3/3291 345/77
2015/0206500 A1* 7/2015 Kim ..... H03K 17/165 345/215
2015/0372095 A1* 12/2015 Saito ..... H01L 21/28568 257/77
2016/0042690 A1 2/2016 Chang et al.
2016/0104419 A1* 4/2016 Chung ..... G09G 3/3225 345/78
2016/0163878 A1* 6/2016 Kanegae ..... H01L 29/66969 257/43
2017/0061892 A1* 3/2017 Jung ..... G09G 3/3291
2017/0064297 A1* 3/2017 Kim ..... G09G 3/006
2017/0067956 A1* 3/2017 Kishi ..... G09G 3/3291
2017/0154556 A1* 6/2017 Cao ..... G09G 3/3266
2017/0186369 A1* 6/2017 Hayashi ..... G09G 3/3233
2017/0271381 A1* 9/2017 Sone ..... H01L 27/1255
2018/0033367 A1* 2/2018 Kim ..... H01L 27/3248
2018/0174517 A1* 6/2018 Lee ..... G09G 3/3233
2018/0322830 A1 11/2018 Xu
2018/0350286 A1* 12/2018 Lee ..... G09G 3/3225
2019/0035322 A1* 1/2019 Kim ..... G09G 3/3266
2019/0057633 A1* 2/2019 Li ..... G09G 3/3258
2019/0228702 A1* 7/2019 Xie ..... G09G 3/3225
2019/0325813 A1* 10/2019 Lo ..... G09G 3/2003
2019/0385513 A1* 12/2019 Iguchi ..... H01L 25/0753
2020/0043420 A1* 2/2020 Kang ..... G09G 3/3225
2020/0090579 A1* 3/2020 Chen ..... G09G 3/3233
2020/0193918 A1* 6/2020 Hwang ..... G09G 3/3225
2020/0243043 A1* 7/2020 Leerentveld ..... G09G 3/3233
2020/0273428 A1* 8/2020 Kim ..... G09G 3/3225
2020/0302840 A1* 9/2020 Kim ..... G09G 3/3233
2020/0380919 A1* 12/2020 Hwang ..... G09G 3/3225
2020/0394965 A1 12/2020 Yuan et al.

FOREIGN PATENT DOCUMENTS

CN 107424549 A 12/2017
CN 107516483 A 12/2017
CN 107610629 A 1/2018
CN 108510922 A 9/2018
CN 108877686 A 11/2018
CN 110111712 A 8/2019
KR 20160018969 A 2/2016
KR 20170080331 A 7/2017

OTHER PUBLICATIONS

International Search Report of PCT/CN2020/085854 and English translation, dated Jul. 13, 2020, 17 pages.

* cited by examiner

METHOD OF DETECTING THRESHOLD VOLTAGE SHIFT AND THRESHOLD VOTAGE SHIFT DETECTION DEVICE

CROSS-REFERENCE TO RELATED APPLICATIONS

This application is the U.S. national phase of PCT Application PCT/CN2020/085854 filed on Apr. 21, 2020, which claims a priority to Chinese Patent Application No. 201910463495.4 filed on May 30, 2019, the disclosures of which are incorporated in their entirety by reference herein.

TECHNICAL FIELD

The present disclosure relates to the field of display technology, and in particular to a method of detecting threshold voltage shift and a threshold voltage shift detection device.

BACKGROUND

When manufacturing a display substrate, various tests are required. However, a testing method in the related art cannot easily obtain a threshold voltage shift state of each transistor in a pixel driving circuit.

SUMMARY

One embodiment of the present disclosures provides a method of detecting threshold voltage shift, applied to a pixel driving circuit which is electrically coupled to a control line, a voltage line and a detection node, respectively, including: in a detection cycle including a setting phase and a detection phase, in the setting phase, controlling a transistor included in the pixel driving circuit to be in a biased state; in the detection phase, providing a preset control voltage signal to the control line, providing a preset voltage signal to the voltage line, and determining a threshold voltage shift state of the transistor according to an electric potential of the detection node.

In implementation, the pixel driving circuit includes a data writing circuit, a driving circuit and a compensation control circuit; the control line includes a gate line and a compensation control line; the voltage line includes a power supply voltage line, a data line, and an external compensation line. In the setting phase, controlling a transistor included in the pixel driving circuit to be in a biased state, includes: in the setting phase, controlling a data writing transistor included in the data writing circuit, a driving transistor included in the driving circuit, or a compensation control transistor included in the compensation control circuit to be in the biased state.

In implementation, the pixel driving circuit includes a data writing circuit, a driving circuit and a compensation control circuit; the control line includes a gate line and the compensation control line; the voltage line includes a power supply voltage line, a data line and an external compensation line. In the detection phase, providing a preset control voltage signal to the control line, providing a preset voltage signal to the voltage line, and determining a threshold voltage shift state of the transistor according to an electric potential of the detection node, includes: in the detection phase, providing a corresponding gate driving voltage signal to the gate line, providing a corresponding data voltage to the data line, providing a corresponding power supply voltage to the power supply voltage line, and determining a threshold voltage shift state of a data writing transistor included in the data writing circuit according to the electric potential of the detection node; or, providing a corresponding compensation control voltage signal to the compensation control line, providing a corresponding compensation voltage signal to the external compensation line, and determining a threshold voltage shift state of a compensation control transistor included in the compensation control circuit according to the electric potential of the detection node; or, providing a corresponding power supply voltage to the power supply voltage line, providing a corresponding gate driving voltage signal to the gate line, providing a corresponding data voltage to the data line, and determining a threshold voltage shift state of a driving transistor included in the driving circuit according to the electric potential of the detection node.

In implementation, a control electrode of the data writing transistor is electrically coupled to the gate line; a first electrode of the data writing transistor is electrically coupled to the data line; and a second electrode of the data writing transistor is electrically coupled to a control terminal of the driving circuit; the pixel driving circuit further includes an energy storage circuit; a first terminal of the energy storage circuit is electrically coupled to the control terminal of the driving circuit; a second terminal of the energy storage circuit is electrically coupled to the detection node. In the setting phase, controlling a transistor included in the pixel driving circuit to be in a biased state, includes: in the setting phase, controlling providing a first voltage signal to the data line and providing a positive voltage signal or a negative voltage signal to the gate line, to control the data writing transistor to be in a forward biased state or a reverse biased state.

In implementation, the detection phase includes a first detection period, a second detection period and a third detection period that are sequentially set. In the detection phase, providing a preset control voltage signal to the control line, providing a preset voltage signal to the voltage line, and determining a threshold voltage shift state of the transistor according to an electric potential of the detection node, includes: in the detection phase, providing a preset first data voltage to the data line, and providing a preset first power supply voltage to the power supply voltage line; in the first detection period, providing a first gate driving voltage signal to the gate line; in the second detection period, providing a second gate driving voltage signal to the gate line; in the third detection period, providing the first gate driving voltage signal to the gate line; after a first preset period, detecting the electric potential of the detection node, and determining the threshold voltage shift state of the data writing transistor according to the electric potential of the detection node.

In implementation, a control electrode of the compensation control transistor is electrically coupled to the compensation control line, a first electrode of the compensation control transistor is electrically coupled to the detection node, and a second electrode of the compensation control transistor is electrically coupled to the external compensation line. In the setting phase, controlling a transistor included in the pixel driving circuit to be in a biased state, includes: in the setting phase, controlling providing a second voltage signal to the external compensation line and providing a positive voltage signal or a negative voltage signal to the compensation control line, to control the compensation control transistor to be in a forward biased state or a reverse biased state.

In implementation, the detection phase includes a first detection period, a second detection period and a third detection period that are sequentially set. In the detection phase, providing a preset control voltage signal to the control line, providing a preset voltage signal to the voltage line, and determining a threshold voltage shift state of the transistor according to an electric potential of the detection node, includes: in the detection phase, providing a preset compensation voltage signal to the external compensation line; in the first detection period, providing a first compensation control voltage signal to the compensation control line; in the second detection period, providing a second compensation control voltage signal to the compensation control line; in the third detection period, providing the first compensation control voltage signal to the compensation control line; and after a second preset period, detecting the electric potential of the detection node, and determining the threshold voltage shift state of the compensation control transistor according to the electric potential of the detection node.

In implementation, a control electrode of the driving transistor is a control terminal of the driving circuit; a first electrode of the driving transistor is electrically coupled to the power supply voltage line; a second electrode of the driving transistor is electrically coupled to the detection node. In the setting phase, controlling a transistor included in the pixel driving circuit to be in a biased state, includes: in the setting phase, providing a preset second data voltage to the data line and providing a third gate driving voltage signal to the gate line, thereby enabling the data writing circuit to control writing the second data voltage into the control electrode of the driving transistor, and providing a preset second power supply voltage to the power supply voltage line to control the driving transistor to be in the biased state.

In implementation, a control electrode of the driving transistor is a control terminal of the driving circuit; a first electrode of the driving transistor is electrically coupled to the power supply voltage line; a second electrode of the driving transistor is electrically coupled to the detection node; the setting phase includes at least one resetting sub-phase, and the resetting sub-phase includes a first setting period, a second setting period and a third setting period that are sequentially set. In the setting phase, controlling a transistor included in the pixel driving circuit to be in a biased state, includes: in the setting phase, providing a preset third data voltage to the data line, and providing a preset third power supply voltage to the power supply voltage line; in the first setting period, providing a fourth gate driving voltage signal to the gate line, thereby enabling the data writing circuit to control writing the third data voltage to the control electrode of the driving transistor; in the second setting period, providing a fifth gate driving voltage signal to the gate line, thereby enabling the data writing circuit to control the data line to be decoupled from the control electrode of the driving transistor; in the third setting period, providing a third voltage signal to the gate line. A difference value between a voltage value of the third voltage signal and 0V is within a preset voltage difference range. A difference value between a duration of the first setting period and a duration of the second setting period is within a preset period difference range.

In implementation, the detection phase includes at least one detection sub-phase; the detection sub-phase includes a first detection period and a second detection period; the first detection period includes a first detection sub-period and a second detection sub-period; the second detection period includes a third detection sub-period and a fourth detection sub-period. In the detection phase, providing a preset control voltage signal to the control line, providing a preset voltage signal to the voltage line, and determining a threshold voltage shift state of the transistor according to an electric potential of the detection node, includes: in the detection phase, providing a preset fourth power supply voltage to the power supply voltage line; in the first detection sub-period, providing a fourth data voltage to the data line and providing a sixth gate driving voltage signal to the gate line, to control the data writing circuit to write the fourth data voltage into a control electrode of the driving transistor; in the second detection sub-period, providing the fourth data voltage to the data line and providing a seventh gate driving voltage signal to the gate line, thereby enabling the data writing circuit to control the data line to be decoupled from the control electrode of the driving transistor; after a third preset period, detecting an electric potential of the detection node, thereby obtaining a first detection electric potential; in the third detection sub-period, providing a fifth data voltage to the data line and providing an eighth gate driving voltage signal to the gate line, to control the data writing circuit to write the fourth data voltage to the control electrode of the driving transistor; in the fourth detection sub-period, providing the fifth data voltage to the data line and providing a ninth gate driving voltage signal to the gate line, thereby enabling the data writing circuit to control the data line to be decoupled from the control electrode of the driving transistor; after a fourth preset period, detecting an electric potential of the detection node, thereby obtaining a second detection electric potential; according to a sum of the first detection electric potential and the second detection electric potential, determining a threshold shift state of the driving transistor One embodiment of the present disclosure further provides a threshold voltage shift detection device, applied to a pixel driving circuit which is electrically connected to a control line, a voltage line and a detection node, respectively, including a setter and a detector. The setter is configured to, in a setting phase, control a transistor included in the pixel driving circuit to be in a biased state. The detector is configured to, in a detection phase, provide a preset control voltage signal to the control line, provide a preset voltage signal to the voltage line, and determine a threshold voltage shift state of the transistor according to an electric potential of the detection node.

DETAILED DESCRIPTION

Figure 1:
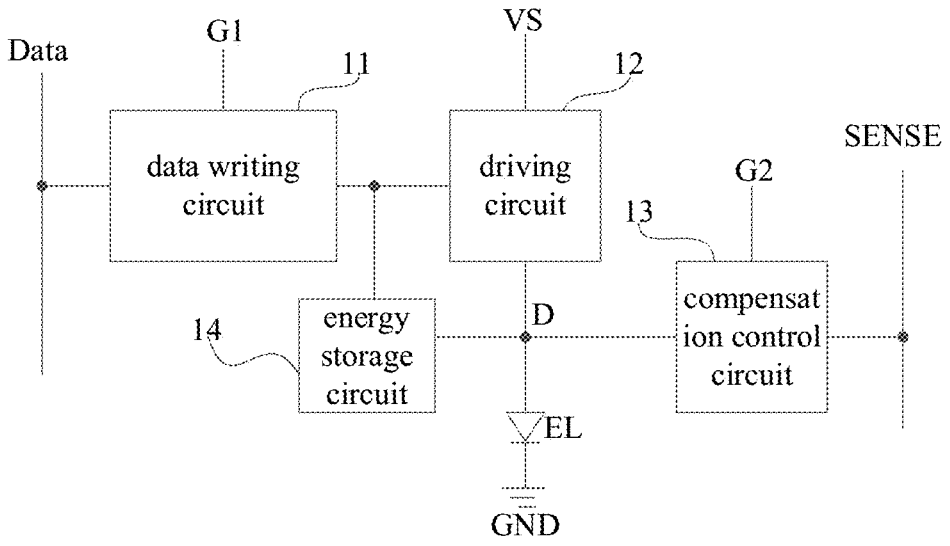
FIG. 1 is a structural diagram of a pixel driving circuit to which a method of detecting threshold voltage shift is applied according to some embodiments of the present disclosure.

The technical solutions of the embodiments of the present disclosure will be clearly and completely described hereinafter in conjunction with the drawings of the embodiments of the present disclosure. It is apparent that the described embodiments are a part of the embodiments of the present disclosure, and not all of them. Based on the embodiments of the present disclosure, all other embodiments obtained by those skilled in the art without creative work fall within the scope of the present disclosure.

In the related art, when manufacturing a display substrate, firstly, a driving circuit layer (the driver circuit layer includes a pixel driving circuit) is arranged on a base substrate to form an array substrate, and then, it is necessary to perform a Bias Temperature Stress (BTS) stability test on a pixel region of the driving circuit layer. After passing the test, a light-emitting element is manufactured on the driving circuit layer.

In the related art, the BTS stability test of the pixel region can only be performed by slicing sample preparation or a test element group (TEG) near the pixel region. The BTS stability test method based on slicing sample preparation includes: slicing an array substrate, cutting a gate electrode, a source electrode and a drain electrode of a thin film transistor by laser, and simultaneously scraping off an insulation layer on an upper surface of the gate electrode, the source electrode and the drain electrode. The BTS stability test method based on slicing sample preparation in the related art is a destructive testing method, and the sample preparation failure rate is high, the efficiency is low, and the sample collection data is small. The TEG near the pixel region is to perform a normal test by applying a voltage to the gate electrode, the source electrode and the drain electrode, but the TEG cannot accurately reflect an actual electrical performance of the pixel region. In the related art, it is impossible to directly perform the BTS test with an array test (AT) device in the current production line, thus a threshold voltage shift state of each transistor in the pixel driving circuit cannot be easily obtained. In view of this, the present disclosure provides a method of detecting threshold voltage shift and a threshold voltage shift detection device, which can solve the problem in the related art that the BTS stability test of the pixel region cannot be directly performed to the array substrate (the array substrate includes a base substrate and a driving circuit layer arranged on the base substrate).

Transistors used in all the embodiments of the present disclosure may be a triode, a thin film transistor or a field effect transistor or other component with the same characteristics. In some embodiments of the present disclosure, in order to distinguish two electrodes of the transistor other than a control electrode, one of the two electrodes is called a first electrode and the other of the two electrodes is called a second electrode.

In the actual operation, when the transistor is a triode, the control electrode may be a base electrode, the first electrode may be a collector electrode, and the second electrode may be an emitter electrode; or, the control electrode may be a base electrode, the first electrode may be an emitter electrode, and the second electrode may be a collector electrode.

In the actual operation, when the transistor is a thin film transistor or a field effect transistor, the control electrode may be a gate electrode, the first electrode may be a drain electrode, and the second electrode may be a source electrode; or, the control electrode may be a gate electrode, the first electrode may be a source electrode, and the second electrode may be a drain electrode.

The method of detecting threshold voltage shift provided in some embodiments of the present disclosure may be applied to a pixel driving circuit. The pixel driving circuit is electrically coupled to a control line, a voltage line and a detection node, respectively. A detection cycle includes a setting phase and a detection phase. The method of detecting threshold voltage shift includes:

in the setting phase, controlling a transistor included in the pixel driving circuit to be in a biased state;

in the detection phase, providing a preset control voltage signal to the control line, providing a preset voltage signal to the voltage line and determining a threshold voltage shift state of the transistor according to an electric potential of the detection node.

In the method of detecting threshold voltage shift provided in some embodiments of the present disclosure, in the setting phase, the transistor included in the pixel driving circuit is controlled to be in the biased state (the biased state is a forward biased state or a reverse biased state); then in the detection phase, a control voltage signal is provided to the control line, a voltage signal is provided to the voltage line, and then a threshold voltage shift state of the transistor is determined according to an electric potential of the detection node, thereby performing bias temperature stress (BTS) test. Further, after the BTS test, the threshold voltage shift state of the transistor included in the pixel driving circuit can be detected, thereby reflecting the BTS stability.

One embodiment of the present disclosure provides a pattern design method for detecting BTS stability of different transistors in the pixel region with an array test (AT) device.

In view of the difficulty that the BTS stability test cannot be directly performed on a pixel region of a current array substrate (the array substrate includes a base substrate and a driving circuit layer arranged on the base substrate), one embodiment of the present disclosure provides a pattern for using the current AT device to perform the BTS test and a threshold voltage shift test of the transistor. Detection images fed back by the AT device can effectively reflect BTS stabilities of all pixel regions in different display substrates included in a whole glass, which has a good guiding significance for residual image analysis and OLED target mura (uneven display) analysis.

As shown in FIG. 1, the pixel driving circuit may include a data writing circuit 11, a driving circuit 12, and a compensation control circuit 13. The control line includes a gate line G1 and a compensation control line G2. The voltage line includes a power supply voltage line VS, a data line Data, and an external compensation line Sense. The pixel driving circuit further includes an energy storage circuit 14.

A control terminal of the data writing circuit 11 is electrically coupled to the gate line G1; a first terminal of the data writing circuit 11 is electrically coupled to the data line Data; a second terminal of the data writing circuit 11 is electrically coupled to a control terminal of the driving circuit 12. The data writing circuit 11 is configured to, under the control of a gate driving voltage signal input by the gate line G1, control turning on a connection between the data line Data and the control terminal of the driving circuit 12.

A first terminal of the driving circuit 12 is electrically coupled to the power supply voltage line VS; and a second terminal of the driving circuit 12 is electrically coupled to a detection node D. The driving circuit 12 is configured to, under the control of an electric potential of the control terminal of the driving circuit 12, control turning on a connection between the power supply voltage line VS and the detection node D.

A control terminal of the compensation control circuit 13 is electrically coupled to the compensation control line G2; a first terminal of the compensation control circuit 13 is electrically coupled to the detection node D; a second terminal of the compensation control circuit 13 is electrically coupled to the external compensation line Sense. The compensation control circuit 13 is configured to, under the control of a compensation control voltage signal input by the compensation control line G2, control turning on a communication between the detection node D and the external compensation line Sense.

A first terminal of the energy storage circuit 14 is electrically coupled to the control terminal of the driving circuit 12. A second terminal of the energy storage circuit 14 is electrically coupled to the detection node D.

In the embodiment of the pixel driving circuit shown in FIG. 1, the detection node D may be electrically coupled to an anode of an organic light-emitting diode EL; and a cathode of the organic light-emitting diode EL may be electrically coupled to a ground terminal GND.

Figure 2:
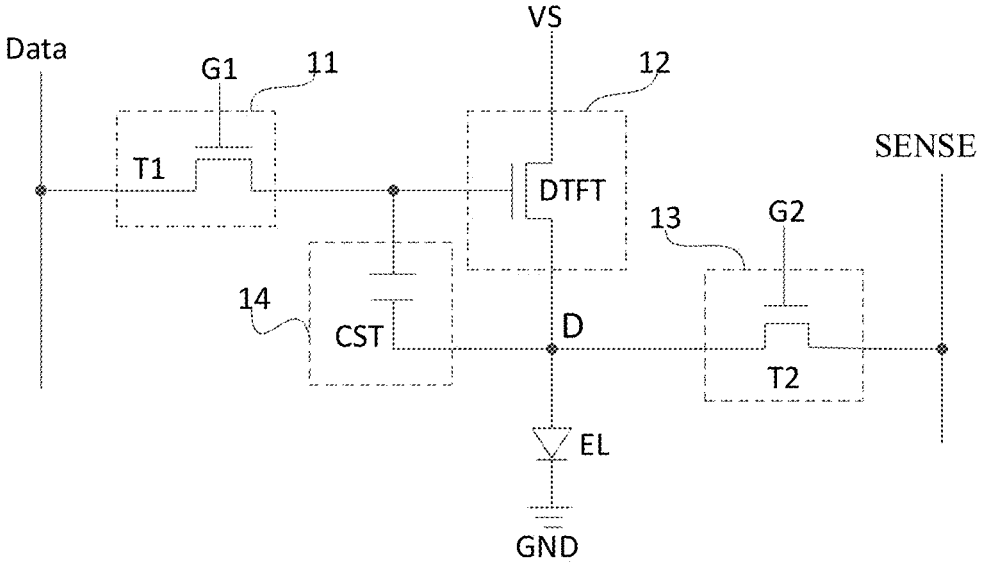
FIG. 2 is a circuit diagram of a specific embodiment of the pixel driving circuit.

As shown in FIG. 2, based on the embodiment of the pixel driving circuit shown in FIG. 1, the data writing circuit 11 may include a data writing transistor T1; the driving circuit 12 may include a driving transistor DTFT; the compensation control circuit 13 may include a compensation control transistor T2; the energy storage circuit 14 may include a storage capacitor CST.

A gate electrode of the data writing transistor T1 is electrically coupled to the gate line G1; a drain electrode of the data writing transistor T1 is electrically coupled to the data line Data; a source electrode of the data writing transistor T1 is electrically coupled to a gate electrode of the driving transistor T2.

A drain electrode of the driving transistor T2 is electrically coupled to the power supply voltage line VS; a source electrode of the driving transistor T2 is electrically coupled to the detection node D.

A gate electrode of the compensation control transistor T2 is electrically coupled to the compensation control line G2. A drain electrode of the compensation control transistor T2 is electrically coupled to the detection node D. A source electrode of the compensation control transistor T2 is electrically connected to the external compensation line Sense.

A first terminal of the storage capacitor CST is electrically coupled to a gate electrode of the DTFT, and a second terminal of the storage capacitor CST is electrically connected to the detection node D.

In the embodiment shown in FIG. 2, T1, DTFT and T2 are all n-type thin film transistors, but not limited to this, the above transistors may also be replaced with p-type transistors.

In specific implementation, a positive bias temperature stress (PBTS) test or a negative bias temperature stress (NBTS) test may be performed on each transistor.

When the PBTS test is performed on each transistor, the transistor is controlled to be in the forward biased state. When the NBTS test is performed on each transistor, the transistor is controlled to be in the reverse biased state.

Specifically, the pixel driving circuit may include the data writing circuit, the driving circuit and the compensation control circuit; the control line includes the gate line and the compensation control line; the voltage line includes the power supply voltage line, the data line, and the external compensation line.

In the setting phase, controlling the transistor included in the pixel driving circuit to be in the biased state, includes: in the setting phase, controlling the data writing transistor included in the data writing circuit, the driving transistor included in the driving circuit, or the compensation control transistor included in the compensation control circuit to be in the biased state.

In some embodiments of the present disclosure, the biased state may be the forward biased state or the reverse biased state.

In the actual operation, a duration for which each of the above transistors is in the forward biased state, may be controlled to be within a preset period range. A duration for which each of the above transistors is in the reverse biased state, may be controlled to be within the preset period range. The preset period range may be greater than or equal to 1 s (second) and less than or equal to 300 s, which is not limited to this.

Specifically, the pixel driving circuit may include the data writing circuit, the driving circuit, and the compensation control circuit; the control line includes the gate line and the compensation control line; the voltage line includes the power supply voltage line, the data line, and the external compensation line.

The step of, in the detection phase, providing the preset control voltage signal to the control line, providing the preset voltage signal to the voltage line, and determining the threshold voltage shift state of the transistor according to the electric potential of the detection node, includes:

in the detection phase, providing a corresponding gate driving voltage signal to the gate line, providing a corresponding data voltage to the data line, providing a corresponding power supply voltage to the power supply voltage line, and determining a threshold voltage shift state of the data writing transistor according to the electric potential of the detection node; or, providing a corresponding compensation control voltage signal to the compensation control line, providing a corresponding compensation voltage signal to the external compensation line, and determining a threshold voltage shift state of the compensation control transistor according to the electric potential of the detection node; or, providing a corresponding power supply voltage to the power supply voltage line, providing a corresponding gate driving voltage signal to the gate line, providing a corresponding data voltage to the data line, and determining a threshold voltage shift state of the driving transistor according to the electric potential of the detection node.

In some embodiments, after controlling the transistor to be in the biased state, the preset control signal may be provided to the corresponding control line, the preset voltage signal may be provided to the corresponding voltage line, and the threshold voltage shift state of the transistor may be determined by the electric potential of the detection node.

Specifically, the control electrode of the data writing transistor is electrically coupled to the gate line, the first electrode of the data writing transistor is electrically coupled to the data line, and the second electrode of the data writing transistor is electrically coupled to the control terminal of the driving circuit. The pixel driving circuit further includes an energy storage circuit. A first terminal of the energy storage circuit is electrically coupled to the control terminal of the driving circuit, and a second terminal of the energy storage circuit is electrically coupled to the detection node.

The step of, in the setting phase, controlling the transistor included in the pixel driving circuit to be in the biased state, includes:

in the setting phase, controlling to provide a first voltage signal to the data line and providing a positive voltage signal or a negative voltage signal to the gate line, thereby controlling the data writing transistor to be in the forward biased state or the reverse biased state.

In specific implementation, the first voltage signal may be a 0V voltage signal, which is not limited to this.

When the PBTS test is performed on the data writing transistor T1 in FIG. 2, the external compensation line Sense, the power supply voltage line VS and the compensation control line G2 may be controlled to be in a turning-off state, a 0V voltage signal may be provided to the data line Data, a +20V voltage (but not limited to this) signal may be provided to the gate line for 1 s to 300 s.

When the NBTS test is performed on the data writing transistor T1 in FIG. 2, the external compensation line Sense, the power supply voltage line VS and the compensation control line G2 may be controlled to be in a turning-off state, a 0V voltage signal may be provided to the data line Data, a −20V voltage signal (but not limited to this) may be provided to the gate line, the 0V voltage signal and the +20V voltage signal may last for 1 s to 300 s.

Specifically, the detection phase may include a first detection period, a second detection period and a third detection period that are sequentially set. The step of in the detection phase, providing the preset control voltage signal to the control line, providing the preset voltage signal to the voltage line, and determining the threshold voltage shift state of the transistor according to the electric potential of the detection node, includes:

in the detection phase, providing a preset first data voltage to the data line, and providing a preset first power supply voltage to the power supply voltage line;

in the first detection period, providing a first gate driving voltage signal to the gate line;

in the second detection period, providing a second gate driving voltage signal to the gate line;

in the third detection period, providing the first gate driving voltage signal to the gate line; and after a first preset period, detecting the electric potential of the detection node, and determining the threshold voltage shift state of the data writing transistor according to the electric potential of the detection node.

In specific implementation, the first power supply voltage may be, for example, a 7V voltage signal, which is not limited to this.

Figure 3:
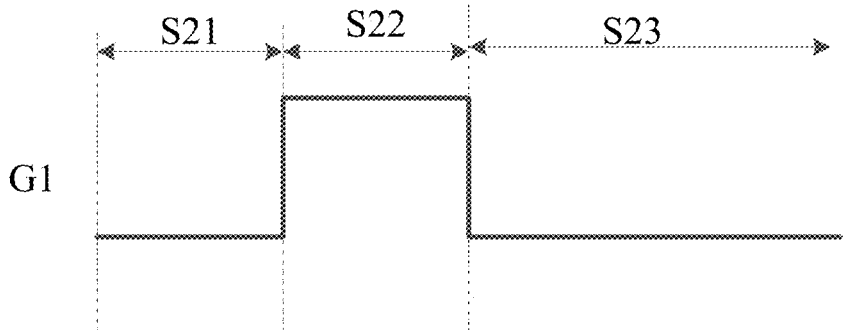
FIG. 3 is a waveform diagram of a signal provided to the pixel driving circuit in a detection phase after performing a BTS test on a data writing transistor T1 in FIG. 2.

In specific implementation, as shown in FIG. 3, after performing the BTS test on the data writing transistor T1 in FIG. 2, a detection phase S2 may include a first detection period S21, a second detection period S22, and a third detection period S23 that are sequentially set.

At the beginning of the detection phase S2, an electric potential of the gate electrode of the DTFT and an electric potential of the detection node D are 0V.

In the detection stage S2, a 4V voltage signal may be provided to the data line Data; a 7V voltage signal may be provided to the power supply voltage line VS; and the compensation control line G2 and the external compensation line Sense may be controlled to be turned off (i.e., not providing the voltage signal to G2 and Sense).

In the first detection period S21, a −1V voltage signal may be provided to the gate line.

In the second detection period S22, a 2V voltage signal may be provided to the gate line.

In the third detection period S23, a −1V voltage signal may be provided to the gate line G1; after the first preset period, the electric potential of the detection node D is detected, and the threshold voltage shift state of the data writing transistor T1 is determined according to the electric potential of the detection node D. When the electric potential of the detection node D is 7V, T1 is normal (that is, there is no threshold voltage shift or slight threshold voltage shift). When the electric potential of the detection node D is 0V, the threshold voltage of the T1 shifts positively; when the electric potential of the detection node D is 4V, the threshold voltage of the T1 shifts negatively.

In specific implementation, a duration of the first detection period S21 may be 4000 us, and a duration of the second detection period S22 may be 400 us; the first preset period may be, for example, 8000 us, but it is not limited to this, but the second detection period is less than 1000 us.

When T1 is normal, in the first detection period S21, T1 is turned off; in the second detection period S22, T1 is turned on, so that the electric potential of the gate electrode of the DTFT becomes 2V; in the third detection period S23, the T1 is turned off, and the gate electrode of the DTFT is in a floating state, so that the electric potential of the detection node D is also bootstrapped up until the electric potential of the detection node D becomes 7V.

When the threshold voltage of T1 shifts positively (a threshold voltage of T1 is greater than 2V), in the first detection period S21, the second detection period S22 and the third detection period S23, T1 is turned off, and the electric potential of the detection node D is 0V.

When the threshold voltage of the T1 shifts negatively (the threshold voltage of T1 is less than −1V), in the first detection period S21, the second detection period S22 and the third detection period S23, T1 is turned on so that the electric potential of the gate electrode of the DTFT remain unchanged, the DTFT is turn on so that VDD of 7V high voltage flows in until it is pinched off, and the electric potential of the detection node D may be greater than 0V and less than 7V.

In specific implementation, the control electrode of the compensation control transistor is electrically coupled to the compensation control line; the first electrode of the compensation control transistor is electrically coupled to the detection node; the second electrode of the compensation control transistor is electrically coupled to the external compensation line. The step of in the setting phase, controlling the transistor included in the pixel driving circuit to be in the biased state, includes:

in the setting phase, controlling to provide a second voltage signal to the external compensation line, and providing a positive voltage signal or a negative voltage signal to the compensation control line to control the compensation control transistor to be in the forward biased state or the reverse biased state.

When the PBTS test is performed on the compensation control transistor T2 in FIG. 2, the data line Data, the power supply voltage line VS and the gate line G1 are controlled to be in the turning-off state, a 0V voltage signal is provided to the external compensation line Sense, and a +20V (but not limited to this) voltage signal is provided to the compensation control line, and the 0V voltage signal and the +20V voltage signal may last for 1 s to 300 s.

When the NBTS test is performed on the compensation control transistor T2 in FIG. 2, the data line Data, the power supply voltage line VS and the gate line G1 are controlled to be in the turning-off state, a 0V voltage signal is provided to the external compensation line Sense, and a −20V (but not limited to this) voltage signal is provided to the compensation control line, and the 0V voltage signal and the −20V voltage signal may last for 1 s to 300 s.

Specifically, the detection phase may include the first detection period, the second detection period and the third detection period that are sequentially set. The step of in the detection phase, providing the preset control voltage signal to the control line, providing the preset voltage signal to the voltage line, and determining the threshold voltage shift state of the transistor according to the electric potential of the detection node, includes:

in the detection phase, providing a preset compensation voltage signal to the external compensation line;

in the first detection period, providing a first compensation control voltage signal to the compensation control line;

in the second detection period, providing a second compensation control voltage signal to the compensation control line;

in the third detection period, providing the first compensation control voltage signal to the compensation control line; and after a second preset period, detecting the electric potential of the detection node, and determining a threshold voltage shift state of the compensation control transistor according to the electric potential of the detection node.

Figure 4:
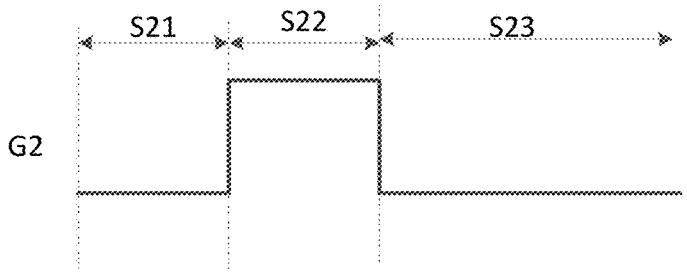
FIG. 4 is a waveform diagram of a signal provided to the pixel driving circuit in a detection phase after performing a BTS test on a compensation control transistor T2 in FIG. 2.

In specific implementation, as shown in FIG. 4, after the BTS test is performed on the compensation control transistor T2 in FIG. 2, the detection phase S2 may include a first detection period S21, a second detection period S22, and a third detection period S23 that are sequentially set.

At the beginning of the detection phase S2, the electric potential of the detection node D is 0V.

In the detection phase S2, a 4V voltage signal may be provided to the external compensation line Sense, and the data line Data, the gate line G1 and the power supply voltage line VS may be controlled to turn off (i.e., not providing the voltage signal to the Data, G1 and VS).

In the first detection period S21, a −1V voltage signal may be provided to the compensation control line G2.

In the second detection period S22, a 2V voltage signal may be provided to the compensation control line G2.

In the third detection period S23, a −1V voltage signal may be provided to the compensation control line G2; after the second preset period, the electric potential of the detection node D is detected; the threshold voltage shift state of the compensation control transistor T2 is determined according to the electric potential of the detection node D. When the electric potential of the detection node D is 2V, T2 is normal; when the electric potential of the detection node D is 0V, the threshold voltage of the T2 shifts positively; when the electric potential of the detection node D is 4V, the threshold voltage of T2 shifts negatively.

The second preset period may be, for example, 8000 ms, which is not limited to this.

When the T2 is normal, in the first detection period S21, T2 is turned off; in the second detection period S22, T2 is turned on, so that the electric potential of the detection node D is 2V; in the third detection period S23, T2 is turned off, and the electric potential of the detection node D is maintained at 2V.

When the threshold voltage of the T2 shifts positively (the threshold voltage of T2 is greater than 2V), in the first detection period S21, the second detection period S22 and the third detection period S23, T2 is turned off, and the electric potential of the detection node D is 0V.

When the threshold voltage of the T2 shifts negatively (the threshold voltage of the T2 is less than −2V), in the second detection period S22, T2 is turned on to control the electric potential of the detection node D to be 4V.

According to a specific embodiment, the control electrode of the driving transistor is the control terminal of the driving circuit; the first electrode of the driving transistor is electrically coupled to the power supply voltage line; and the second electrode of the driving transistor is electrically coupled to the detection node. The step of in the setting phase, controlling the transistor included in the pixel driving circuit to be in the biased state, includes:

in the setting phase, providing a preset second data voltage to the data line, and providing a third gate driving voltage signal to the gate line, so that the data writing circuit controls writing the second data voltage into the control electrode of the driving transistor, and providing a preset second power supply voltage to the power supply voltage line to control the driving transistor to be in the biased state.

In some embodiments, the second power supply voltage may be 0V voltage signal, which is not limited to this.

When the NBTS test is performed on the driving transistor DTFT in FIG. 2, the external compensation line Sense and the compensation control line G2 may be controlled to be in the turning-off state, a 0V voltage signal is provided to the power supply voltage line VS, a 0V (but not limited to this) voltage signal is provided to the gate line G1, a −20V voltage signal is provided to the data line Data, and the 0V voltage signal and the −20V voltage signal may last for 1 s to 300 s.

According to another embodiment, the control electrode of the driving transistor is the control terminal of the driving circuit, the first electrode of the driving transistor is electrically coupled to the power supply voltage line, and the second electrode of the driving transistor is electrically coupled to the detection node. The setting phase includes at least one resetting sub-phase, and the resetting sub-phase includes a first setting period, a second setting period and a third setting period that are sequentially set. The step of in the setting phase, controlling the transistor included in the pixel driving circuit to be in the biased state, includes:

in the setting phase, providing a preset third data voltage to the data line, and providing a preset third power supply voltage to the power supply voltage line;

in the first setting period, providing a fourth gate driving voltage signal to the gate line, so that the data writing circuit controls writing the third data voltage to the control electrode of the driving transistor;

in the second setting period, providing a fifth gate driving voltage signal to the gate line, so that the data writing circuit controls the data line to be decoupled from the control electrode of the driving transistor;

in the third setting period, providing a third voltage signal to the gate line, where a difference value between a voltage value of the third voltage signal and 0V is within a preset voltage difference range;

a difference value between a duration of the first setting period and a duration of the second setting period is within a preset period difference range.

In some embodiments of the present disclosure, the preset voltage difference range may be, for example, greater than or equal to −0.2V and less than or equal to 0.2V, which is not limited to this.

The preset period difference range may be, for example, greater than or equal to −2 s and less than or equal to 2 s, which is not limited to this.

In specific implementation, the third power supply voltage may be the 0V voltage signal, which is not limited to this.

When the PBTS test is performed on the driving transistor DTFT in FIG. 2, the external compensation line Sense and the compensation control line G2 may be controlled to be in the turning-off state, and a 0V voltage signal is provided to the power supply voltage line VS.

Figure 5:
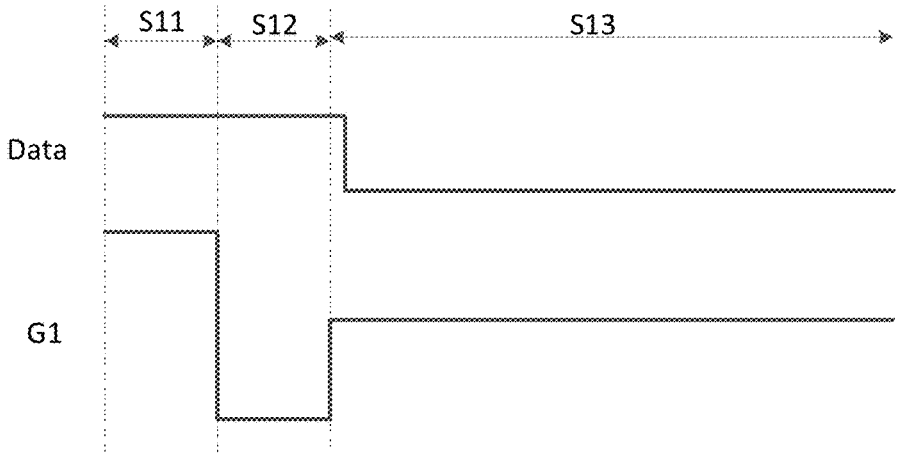
FIG. 5 is a waveform diagram of a signal provided to the pixel driving circuit in a resetting phase when performing a PBTS test on a driving transistor DTFT in FIG. 2.

As shown in FIG. 5, the setting phase includes at least one resetting sub-phase, and the resetting sub-phase includes a first setting period S11, a second setting period S12 and a third setting period S13 that are sequentially set.

In the first setting period S11, a 20V voltage signal is provided to the data line Data, and a +22V voltage signal is provided to the gate line G1; at this point, T1 is turned on, and the 20V voltage signal is written into the gate electrode of the DTFT to control the DTFT to be in the forward biased state; at this point, T1 is in the forward biased state.

In the second setting period S12, a 20V voltage signal is provided to the data line Data, and a −22V voltage signal is provided to the gate line G1; T1 is turned off, and the T1 is in the reverse biased state.

In the third setting period S13, a 0V voltage signal is provided to the data line Data, a 0V voltage signal is provided to the gate line G1, and T1 is turned off.

The pattern shown in FIG. 5 is provided in the embodiments of the present disclosure; when controlling the DTFT to be in the forward biased state, by setting the duration of S11 and the duration of S12 to be similar, the threshold voltage of the T1 is controlled to not shift significantly.

Specifically, the detection phase includes at least one detection sub-phase; the detection sub-phase includes a first detection period and a second detection period. The first detection period includes a first detection sub-period and a second detection sub-period. The second detection period includes a third detection sub-period and a fourth detection sub-period. The step of in the detection phase, providing the preset control voltage signal to the control line, providing the preset voltage signal to the voltage line, and determining the threshold voltage shift state of the transistor according to the electric potential of the detection node, includes:

in the detection phase, providing a preset fourth power supply voltage to the power supply voltage line, to control the compensation control line and the external compensation line to be in a turning-off state;

in the first detection sub-period, providing a fourth data voltage to the data line and providing a sixth gate driving voltage signal to the gate line, to control the data writing circuit to write the fourth data voltage into the control electrode of the driving transistor;

in the second detection sub-period, providing the fourth data voltage to the data line and providing a seventh gate driving voltage signal to the gate line, thereby enabling the data writing circuit to control the data line to be decoupled from the control electrode of the driving transistor; after a third preset period, detecting the electric potential of the detection node, thereby obtaining a first detection electric potential;

in the third detection sub-period, providing a fifth data voltage to the data line and providing an eighth gate driving voltage signal to the gate line, to control the data writing circuit to write the fourth data voltage to the control electrode of the driving transistor;

in the fourth detection sub-period, providing the fifth data voltage to the data line and providing a ninth gate driving voltage signal to the gate line, thereby enabling the data writing circuit to control the data line to be decoupled from the control electrode of the driving transistor; after a fourth preset period, detecting an electric potential of the detection node, thereby obtaining a second detection electric potential, according to a sum of the first detection electric potential and the second electric detection potential, determining the threshold shift state of the driving transistor.

In some embodiments of the present disclosure, the fourth power supply voltage may be 5V, but is not limited to this.

Figure 6:
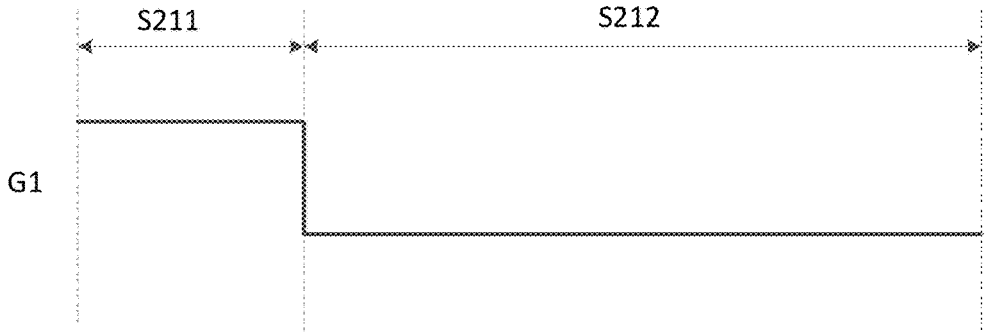
FIG. 6 is a waveform diagram of a signal provided to the pixel driving circuit in a first detection period included in the detection phase when detecting whether a threshold voltage of the driving transistor DTFT in FIG. 2 shifts.
Figure 7:
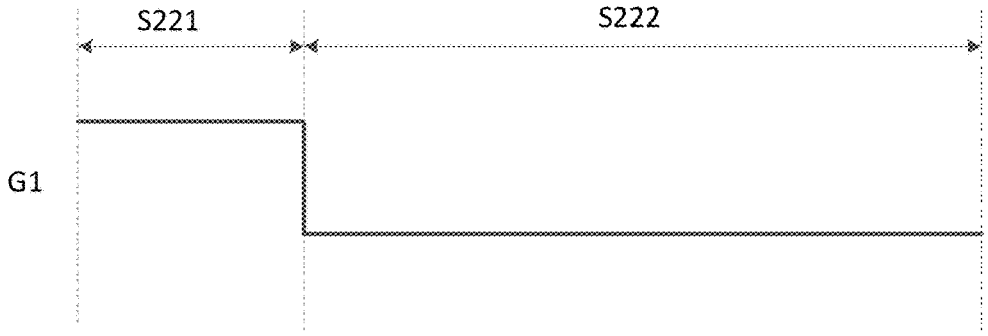
FIG. 7 is a waveform diagram of a signal provided to the pixel driving circuit in a second detection period included in the detection phase when detecting whether a threshold voltage of the driving transistor DTFT in FIG. 2 shifts.

In specific implementation, when detecting whether the threshold voltage of the driving transistor DTFT in FIG. 2 shifts, the detection phase may include at least one detection sub-phase. The detection sub-phase includes a first detection period and a second detection period. As shown in FIG. 6, the first detection period S21 includes a first detection sub-period S211 and a second detection sub-period S212. As shown in FIG. 7, the second detection period S22 includes a third detection sub-period S221 and a fourth detection sub-period S222.

In the detection phase, a +5V voltage signal is provided to the power supply voltage line VS, and the compensation control line G2 and the external compensation line Sense are controlled to be in the turning-off state (i.e., not providing voltage signals to G2 and Sense).

A duration of the first detection sub-period S211 may be, for example, 4000 us, and a duration of the second detection sub-period S212 may be, for example, 12000 us, but is not limited to this. A duration of the third detection sub-period S221 may be, for example, 4000 us, and a duration of the fourth detection sub-period S222 may be, for example, 12000 us, but is not limited to this.

At the beginning of the detection phase, the electric potential of the detection node D is 0V.

As shown in FIG. 6, in the first detection sub-period S211, a +1V voltage signal is provided to the data line Data and a +6V voltage signal is provided to the gate line G1, to control T1 to turn on, thereby writing the +1V voltage signal to the gate electrode of the driving transistor DTFT.

In the second detection sub-period S212, a +1V voltage signal is provided to the data line Data and a −6V voltage signal is provided to the gate line G1, so that T1 is turned off to control the data line Data to be decoupled from the gate of the driving transistor DTFT; after the third preset period, an electric potential of the detection node D is detected and taken as a first detection electric potential V1. The third preset period may be, for example, 12000 us, but is not limited to this.

As shown in FIG. 7, in the third detection sub-period S221, a −1V voltage signal is provided to the data line Data and a +6V voltage signal is provided to the gate line, to control T1 to turn on, thereby writing the −1V voltage signal into the gate electrode of the driving transistor DTFT.

In the fourth detection sub-period S222, a −1V voltage signal is provided to the data line and a −6V voltage signal is provided to the gate line, so that T1 is turned off to control the data line Data to de decoupled from the gate electrode of the driving transistor DTFT; after the fourth preset period, an electric potential of the detection node D is detected and taken as a second detection electric potential V2. The fourth preset period may be, for example, 12000 us, but is not limited to this.

According to a sum of the first detection electric potential V1 and the second detection electric potential V2, the threshold shift state of the driving transistor DTFT is determined.

In the actual operation, when the DTFT is normal, the V1 is equal to 5V; when the threshold voltage of the DTFT shifts positively, the V1 is equal to 0V; when the threshold voltage of the DTFT shifts negatively direction, the V1 is equal to 5V.

When the DTFT is normal, the V2 is equal to 0V; when the threshold voltage of the DTFT shifts positively, the V2 is equal to 0V; when the threshold voltage of the DTFT shifts negatively, the V2 is equal to 5V.

Then, when the sum of the V1 and the V2 is equal to 5V, it indicates that the DTFT is normal; when the sum of the V1 and the V2 is equal to 0V, it indicates that the threshold voltage of the DTFT shifts positively; when the sum of the V1 and the V2 is equal to 10V, it indicates that the threshold voltage of the DTFT shifts negatively.

In specific implementation, when the DTFT is normal, in the first detection sub-period S211, the gate electrode of the driving transistor DTFT receives a +1V voltage signal, and the DTFT is turned on first until an electric potential of the detection node D becomes +1V, then the DTFT is turned off; in the second detection sub-period S212, the T1 is turned off, and the gate electrode of the DTFT is in a floating state, so that the electric potential of the detection node D is also bootstrapped up until the electric potential of the detection node D becomes 5V; at this point, the V1 is equal to 5V.

When the threshold voltage of the DTFT shifts positively (the threshold voltage of the DTFT is greater than 1V), in the first detection sub-period S211, the gate electrode of the driving transistor DTFT receives a +1V voltage signal, and the DTFT is turned off; in the second detection sub-period S212, the T1 is turned off and the DTFT is also turned off, then the electric potential of the detection node D remains at 0V, and at this point, the V1 is equal to 0V.

When the threshold voltage of the DTFT shifts negatively, in the first detection sub-period S211, the gate electrode of the driving transistor DTFT receives a +1V voltage signal, and the DTFT is turned on; in the second detection sub-period S212, the T1 is turned off, and the gate electrode of the DTFT is in the floating state, so that the electric potential of the detection node D is also bootstrapped up until the electric potential of the detection node D becomes 5V, and at this point, the V1 is equal to 5V.

When the DTFT is normal, in the third detection sub-period S221, the gate electrode of the driving transistor DTFT receives the −1V voltage signal, and the DTFT is turned off; in the fourth detection sub-period S222, the T1 is turned off, and the DTFT is still turned off at this point, then the electric potential of the detection node D is 0V, that is, the V2 is equal to 0V.

When the threshold voltage of the DTFT shifts positively, in the third detection sub-period S221, the gate electrode of the driving transistor DTFT receives the −1V voltage signal, and the DTFT is turned off; in the fourth detection sub-period S222, the T1 is turned off, and the DTFT is still turned off at this point, the electric potential of the detection node D is 0V, that is, the V2 is equal to 0V.

When the threshold voltage of the DTFT shifts negatively (the threshold voltage of the DTFT is less than −1V), in the third detection sub-period S221, the gate electrode of the driving transistor DTFT receive the −1V voltage signal, and the DTFT is turned on; in the fourth detection sub-period S222, the T1 is turned off; at this point, the gate electrode of the DTFT is in the floating state, so that the electric potential of the detection node D is also bootstrapped until the electric potential of the detection node D becomes 5V, and the V2 is equal to 5V at this point.

One embodiment of the present disclosure provides a threshold voltage shift detection device, which is applied to a pixel driving circuit. The pixel driving circuit is electrically coupled to a control line, a voltage line and a detection node, respectively. The threshold voltage shift detection device includes a setter and a detector.

The setter is configured to, in a setting phase, control a transistor included in the pixel driving circuit to be in a biased state.

The detector is configured to, in a detection phase, provide a preset control voltage signal to the control line and a preset voltage signal to the voltage line, and determine a threshold voltage shift state of the transistor according to an electric potential of the detection node.

According to the threshold voltage shift detection device provided in some embodiments of the present disclosure, in the setting phase, the setter controls the transistor included in the pixel driving circuit to be in the biased state (the biased state is the forward biased state or the reverse biased state); then in the detection phase, the detector provides the control voltage signal to the control line and provides the voltage signal to the voltage line and determines the threshold shift state of the transistor according to the electric potential of the detection node. In this way, the bias temperature stress (BTS) test can be performed, and the threshold voltage shift state of the transistor included in the pixel driving circuit can be detected after the BTS test to reflect the BTS stability.

Persons having ordinary skill in the art may obtain that, taking into account various embodiments of the present disclosure, units and algorithm blocks described in each example may be implemented by electronic hardware such as circuit, or in a combination of computer software and electronic hardware. Whether these functions are implemented by using hardware or software depends on specific application, and design constraints of the technical solution. A skilled person may adopt different methods to implement described functions of each specific application, but such implementation should not be considered to extend beyond the scope of the present disclosure.

Persons having ordinary skill in the art may clearly understand that, for convenient and concise of the description, specific work process of foregoing system, device and unit may refer to a corresponding process in method embodiments, which are not repeated here.

In the embodiments of the application, it should be understood that, the disclosed device and method may be implemented by using other methods. For example, device embodiments described above are only illustrative, e.g., division of the unit is only a logical division, there may be additional division methods during actual implementation. For example, multiple units or components may be combined, or integrated into another system. Alternatively, some features may be omitted, or not performed. From another point of view, the mutual coupling shown or discussed, or direct coupling, or communication connection may be through some interfaces. The indirect coupling, or communication connection among devices or units may be electronic, mechanical, or in other form.

Units described as separate components may be, or may be not physically separated. Components, displayed as units, may be or may be not a physical unit, which may be located in one place, or may be distributed to multiple network units.

Some units, or all the units may be selected to implement the objectives of the solution in the embodiment, based on actual requirements.

In addition, in various embodiments of the present disclosure, each functional unit may be integrated into one processing unit. Alternatively, each unit may exist physically alone. Still alternatively, two or more units may be integrated into one unit.

The above are optional embodiments of the present disclosure. It should be pointed out that, for persons having ordinary skill in the art, several improvements and changes may be made, without departing from the principle of the present disclosure. These improvements and changes should also be within the scope of the present disclosure.

What is claimed is:

1. A method of detecting threshold voltage shift during fabrication of a display substrate, applied to a pixel driving circuit which is electrically coupled to a control line, a voltage line and a detection node, respectively, comprising: in a detection cycle including a setting phase and a detection phase, before fabricating a light-emitting element on a driving circuit layer including the pixel driving circuit of an array substrate of the display substrate, in the setting phase, controlling a transistor included in the pixel driving circuit to be in a biased state;

in the detection phase, providing a preset control voltage signal to the control line, providing a preset voltage signal to the voltage line, and determining a threshold voltage shift state of the transistor according to an electric potential of the detection node, wherein the pixel driving circuit includes a data writing circuit, a driving circuit and a compensation control circuit; the control line includes a gate line and a compensation control line; the voltage line includes a power supply voltage line, a data line, and an external compensation line, wherein in the setting phase, controlling a transistor included in the pixel driving circuit to be in a biased state, includes: in the setting phase, controlling a data writing transistor included in the data writing circuit, a driving transistor included in the driving circuit, or a compensation control transistor included in the compensation control circuit to be in the biased state, wherein the detection phase includes a first detection period, a second detection period and a third detection period that are sequentially set, and wherein in the detection phase, providing a preset control voltage signal to the control line, providing a preset voltage signal to the voltage line, and determining a threshold voltage shift state of the transistor according to an electric potential of the detection node, includes:

in the detection phase, providing a preset first data voltage to the data line, and providing a preset first power supply voltage to the power supply voltage line;

in the first detection period, providing a first gate driving voltage signal to the gate line;

in the second detection period, providing a second gate driving voltage signal to the gate line; and in the third detection period, providing the first gate driving voltage signal to the gate line; after a first preset period, detecting the electric potential of the detection node, and determining the threshold voltage shift state of the data writing transistor according to the electric potential of the detection node.

2. The method according to claim 1, wherein a control electrode of the data writing transistor is electrically coupled to the gate line; a first electrode of the data writing transistor is electrically coupled to the data line; and a second electrode of the data writing transistor is electrically coupled to a control terminal of the driving circuit; the pixel driving circuit further includes an energy storage circuit; a first terminal of the energy storage circuit is electrically coupled to the control terminal of the driving circuit; a second terminal of the energy storage circuit is electrically coupled to the detection node;

wherein in the setting phase, controlling a transistor included in the pixel driving circuit to be in a biased state, includes:

in the setting phase, controlling providing a first voltage signal to the data line and providing a positive voltage signal or a negative voltage signal to the gate line, to control the data writing transistor to be in a forward biased state or a reverse biased state.

3. The method according to claim 1, wherein a control electrode of the compensation control transistor is electrically coupled to the compensation control line, a first electrode of the compensation control transistor is electrically coupled to the detection node, and a second electrode of the compensation control transistor is electrically coupled to the external compensation line;

wherein in the setting phase, controlling a transistor included in the pixel driving circuit to be in a biased state, includes:

in the setting phase, controlling providing a second voltage signal to the external compensation line and providing a positive voltage signal or a negative voltage signal to the compensation control line, to control the compensation control transistor to be in a forward biased state or a reverse biased state.

4. The method according to claim 1, wherein a control electrode of the driving transistor is a control terminal of the driving circuit; a first electrode of the driving transistor is electrically coupled to the power supply voltage line; a second electrode of the driving transistor is electrically coupled to the detection node;

wherein in the setting phase, controlling a transistor included in the pixel driving circuit to be in a biased state, includes:

in the setting phase, providing a preset second data voltage to the data line and providing a third gate driving voltage signal to the gate line, thereby enabling the data writing circuit to control writing the second data voltage into the control electrode of the driving transistor, and providing a preset second power supply voltage to the power supply voltage line to control the driving transistor to be in the biased state.

5. The method according to claim 1, wherein a control electrode of the driving transistor is a control terminal of the driving circuit; a first electrode of the driving transistor is electrically coupled to the power supply voltage line; a second electrode of the driving transistor is electrically coupled to the detection node; the setting phase includes at least one resetting sub-phase, and the resetting sub-phase includes a first setting period, a second setting period and a third setting period that are sequentially set;

wherein in the setting phase, controlling a transistor included in the pixel driving circuit to be in a biased state, includes:

in the setting phase, providing a preset third data voltage to the data line, and providing a preset third power supply voltage to the power supply voltage line;

in the first setting period, providing a fourth gate driving voltage signal to the gate line, thereby enabling the data writing circuit to control writing the third data voltage to the control electrode of the driving transistor;

in the second setting period, providing a fifth gate driving voltage signal to the gate line, thereby enabling the data writing circuit to control the data line to be decoupled from the control electrode of the driving transistor;

in the third setting period, providing a third voltage signal to the gate line;

wherein a difference value between a voltage value of the third voltage signal and 0V is within a preset voltage difference range;

wherein a difference value between a duration of the first setting period and a duration of the second setting period is within a preset period difference range.

6. A method of detecting threshold voltage shift during fabrication of a display substrate, applied to a pixel driving circuit which is electrically coupled to a control line, a voltage line and a detection node, respectively, comprising: in a detection cycle including a setting phase and a detection phase, before fabricating a light-emitting element on a driving circuit layer including the pixel driving circuit of an array substrate of the display substrate, in the setting phase, controlling a transistor included in the pixel driving circuit to be in a biased state;

in the detection phase, providing a preset control voltage signal to the control line, providing a preset voltage signal to the voltage line, and determining a threshold voltage shift state of the transistor according to an electric potential of the detection node, wherein the pixel driving circuit includes a data writing circuit, a driving circuit and a compensation control circuit; the control line includes a gate line and a compensation control line; the voltage line includes a power supply voltage line, a data line, and an external compensation line, wherein in the setting phase, controlling a transistor included in the pixel driving circuit to be in a biased state, includes: in the setting phase, controlling a data writing transistor included in the data writing circuit, a driving transistor included in the driving circuit, or a compensation control transistor included in the compensation control circuit to be in the biased state, wherein the detection phase includes a first detection period, a second detection period and a third detection period that are sequentially set, and wherein in the detection phase, providing a preset control voltage signal to the control line, providing a preset voltage signal to the voltage line, and determining a threshold voltage shift state of the transistor according to an electric potential of the detection node, includes:

in the detection phase, providing a preset compensation voltage signal to the external compensation line;

in the first detection period, providing a first compensation control voltage signal to the compensation control line;

in the second detection period, providing a second compensation control voltage signal to the compensation control line; and in the third detection period, providing the first compensation control voltage signal to the compensation control line; and after a second preset period, detecting the electric potential of the detection node, and determining the threshold voltage shift state of the compensation control transistor according to the electric potential of the detection node.

7. A method of detecting threshold voltage shift during fabrication of a display substrate, applied to a pixel driving circuit which is electrically coupled to a control line, a voltage line and a detection node, respectively, comprising: in a detection cycle including a setting phase and a detection phase, before fabricating a light-emitting element on a driving circuit layer including the pixel driving circuit of an array substrate of the display substrate, in the setting phase, controlling a transistor included in the pixel driving circuit to be in a biased state;

in the detection phase, providing a preset control voltage signal to the control line, providing a preset voltage signal to the voltage line, and determining a threshold voltage shift state of the transistor according to an electric potential of the detection node, wherein the pixel driving circuit includes a data writing circuit, a driving circuit and a compensation control circuit; the control line includes a gate line and a compensation control line; the voltage line includes a power supply voltage line, a data line, and an external compensation line, wherein in the setting phase, controlling a transistor included in the pixel driving circuit to be in a biased state, includes: in the setting phase, controlling a data writing transistor included in the data writing circuit, a driving transistor included in the driving circuit, or a compensation control transistor included in the compensation control circuit to be in the biased state, wherein the detection phase includes at least one detection sub-phase; the detection sub-phase includes a first detection period and a second detection period; the first detection period includes a first detection sub-period and a second detection sub-period; the second detection period includes a third detection sub-period and a fourth detection sub-period, and wherein in the detection phase, providing a preset control voltage signal to the control line, providing a preset voltage signal to the voltage line, and determining a threshold voltage shift state of the transistor according to an electric potential of the detection node, includes:

in the detection phase, providing a preset fourth power supply voltage to the power supply voltage line in the first detection sub-period, providing a fourth data voltage to the data line and providing a sixth gate driving voltage signal to the gate line, to control the data writing circuit to write the fourth data voltage into a control electrode of the driving transistor;

in the second detection sub-period, providing the fourth data voltage to the data line and providing a seventh gate driving voltage signal to the gate line, thereby enabling the data writing circuit to control the data line to be decoupled from the control electrode of the driving transistor; after a third preset period, detecting an electric potential of the detection node, thereby obtaining a first detection electric potential;

in the third detection sub-period, providing a fifth data voltage to the data line and providing an eighth gate driving voltage signal to the gate line, to control the data writing circuit to write the fourth data voltage to the control electrode of the driving transistor;

in the fourth detection sub-period, providing the fifth data voltage to the data line and providing a ninth gate driving voltage signal to the gate line, thereby enabling the data writing circuit to control the data line to be decoupled from the control electrode of the driving transistor; after a fourth preset period, detecting an electric potential of the detection node, thereby obtaining a second detection electric potential; and according to a sum of the first detection electric potential and the second detection electric potential, determining a threshold shift state of the driving transistor.

* * * * *